US005131326A

United States Patent [19]

Wrzesinski

[11] Patent Number: 5,131,326

[45] Date of Patent: Jul. 21, 1992

[54] COVER MOUNTING FOR A PRINTING PRESS

[75] Inventor: Alvin J. Wrzesinski, Chicago, Ill.

[73] Assignee: Rockwell International Corporation, El Segundo, Calif.

[21] Appl. No.: 747,305

[22] Filed: Aug. 19, 1991

[51] Int. Cl.[5] ..... B41F 1/28

[52] U.S. Cl. ..... 101/415.1; 101/378; 101/382.1; 101/383; 101/384; 428/909

[58] Field of Search ..... 101/415.1, 378, 382.1, 101/383, 384, 385; 428/909

[56] References Cited

U.S. PATENT DOCUMENTS

| | | | |
|---|---|---|---|
| 1,938,579 | 12/1933 | Chisholm | 101/382.1 |
| 2,005,749 | 6/1935 | Osborn | 101/382.1 |
| 3,896,727 | 7/1975 | Ruckdeschel, Jr. | 101/415.1 |
| 4,133,264 | 1/1979 | Fermi et al. | 101/415.1 |
| 4,191,106 | 3/1980 | Fermi et al. | 101/415.1 |
| 4,848,229 | 7/1989 | Grosshauser et al. | 101/415.1 |

*Primary Examiner*—Edgar S. Burr
*Assistant Examiner*—Anthony H. Nguyen
*Attorney, Agent, or Firm*—C. B. Patti; V. L. Sewell; H. F. Hamann

[57] ABSTRACT

A cover mounting (10) for a printing press (14) having a rotatably mounted roll (12) having an elongated lateral recess (16) extending from an outer surface (18) of the roll (12), a bracket (20) having a pair of outwardly directed flanges (22) and (24) in said recess (16), and a blanket (30) for covering said roll (12), said blanket (30) having a pair of clips (44) and (46) adjacent opposed ends of the blanket (30), with each of said clips (44) and (46) having a pair of opposed spaced resilient clipping members (48) and (50) for placement on each of the bracket flanges (22) and (24) in said recess (16).

15 Claims, 5 Drawing Sheets

COVER MOUNTING FOR A PRINTING PRESS

BACKGROUND OF THE INVENTION

The present invention relates to cover mountings for a printing press.

In the past, printing presses have been constructed with a plurality of rotatable rolls for supplying ink to a moving web for printing on the web. Such rolls may include an ink roll for receiving ink, or a plate cylinder having a plate mounted on the plate cylinder for forming an impression of the ink on the web. In the case of the ink roll, it may be desirable to provide a cover for the ink roll.

In either case, however, it has been difficult and time consuming to attach the covers on the rolls either before press run or during a press run when it is desirable to change covers, such as when colors are changed on the press. The prior covers have required the use of tools for securing the cover on the roll, and the tools may be dropped into a lower part of the press causing damage to the press. In addition, the attachment procedure has been unduly complex resulting in excessive down time of the press for this purpose.

SUMMARY OF THE INVENTION

A principal feature of the present invention is the provision of an improved cover mounting for a printing press.

The cover mounting of the present invention comprises, a rotatably mounted roll having an elongated lateral recess extending from an outer surface of the roll, a bracket in the recess having a pair of outwardly directed flanges, and a blanket for covering the roll.

A feature of the present invention is that the blanket has a pair of clips adjacent opposed ends of the blanket.

A further feature of the invention is that the clips may be releasably secured on the flanges of the bracket.

Thus, a feature of the invention is that the blanket may be secured by the clips in a simplified manner on the bracket.

Still another feature of the invention is that the attachment procedure is simplified, and reduces the down time of the press.

Another feature of the invention is that the blanket may be closed adjacent an outer portion of the recess due to side margins of the blanket being located adjacent each other in the recess after securement of the blanket to the bracket.

A further feature of the invention is that the blanket may be easily removed from the roll by removing the clips from the flanges of the bracket.

Thus, a feature of the present invention is that different blankets may be readily changed in the press in a simplified manner.

A further feature of the invention is that the cover mounting eliminates the necessity of utilizing tools in order to secure the blanket on the roll.

Thus, a feature of the present invention is that the cover mounting eliminates the possibility that tools may be dropped into a lower portion of the press which may otherwise cause damage to the press.

Yet another feature of the invention is that the cover mounting is of simplified construction and reduced cost.

Further features will become more fully apparent in the following description of the embodiments of this invention, and from the appended claims.

DESCRIPTION OF THE PREFERRED EMBODIMENTS

Figure 1:
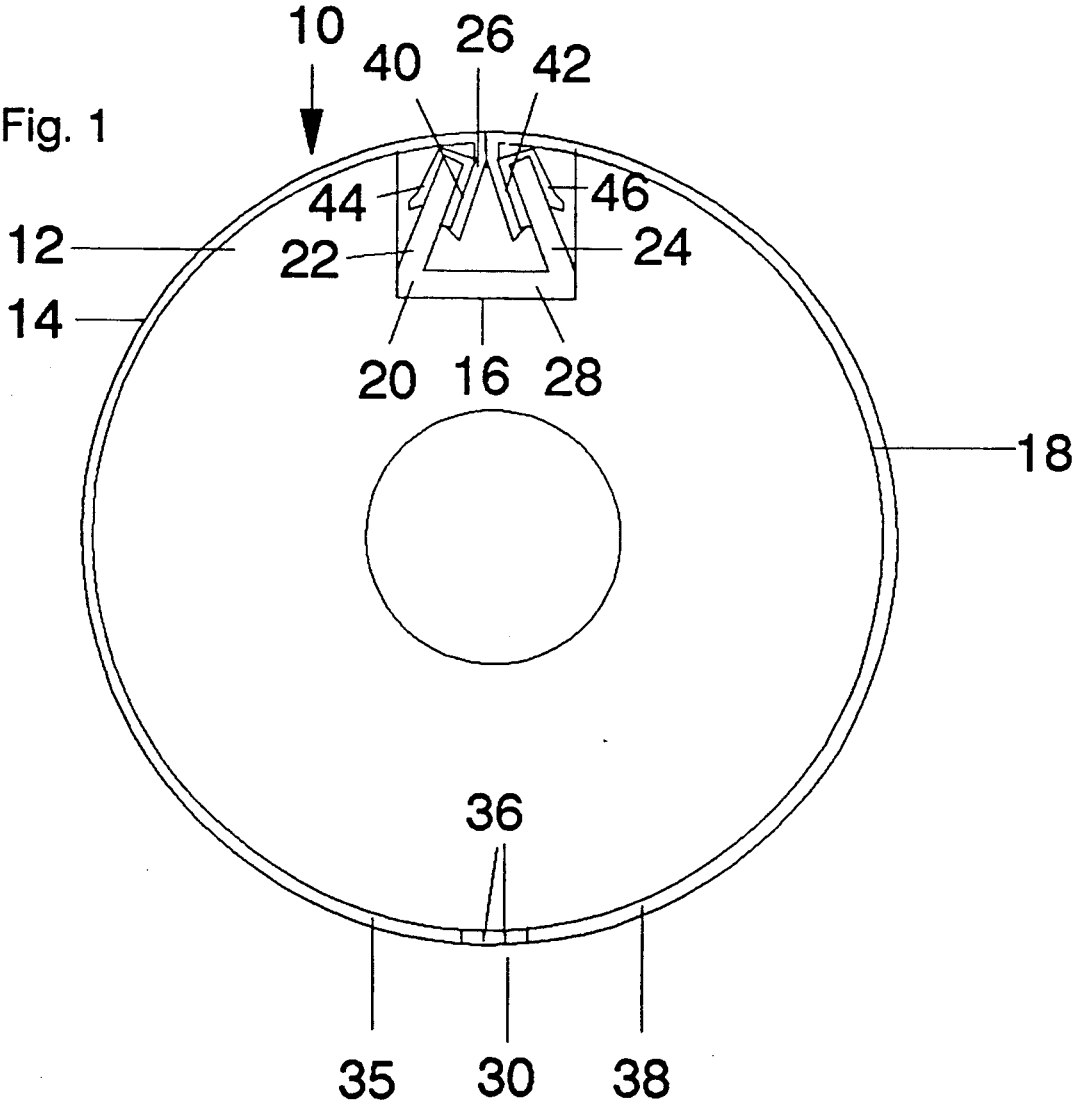
FIG. 1 is a side elevational view of a cover mounting for a roll in a printing press of the present invention.
Figure 2:
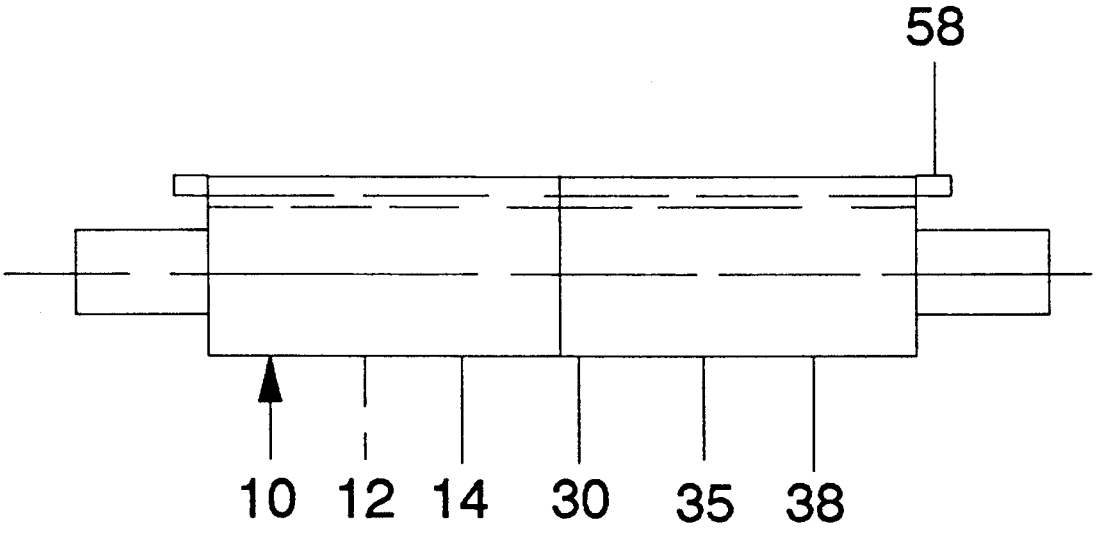
FIG. 2 is an elevational view of the cover mounting and roll of FIG. 1.

Referring now to FIGS. 1 and 2, there is shown a cover mounting generally designated 10 for a roll or cylinder 12 of a printing press 14. In one form, the roll 12 may comprise an ink roll positioned adjacent a supply of ink in order to receive the ink and pass the ink to remaining parts of the press 14. In an alternative form, the roll or roller 12 may comprise a plate cylinder having an outer plate with an image for printing on a moving web, such as paper.

As shown, the roll 12 has an outer elongated recess 16 which may be of generally rectangular shape. The recess 16 extends to an outer surface 18 of the roll 12, as shown.

As shown in FIG. 1, the roll 12 has an elongated bracket 20 having a pair of elongated first and second flanges 22 and 24, respectively, directed in the recess 16 towards the outer surface 18 of the roll 12. In addition, outer ends of the first and second flanges 22 and 24 are directed towards each other, and form an elongated slot 26 between the flanges 22 and 24 adjacent the outer surface 18 of the roll 12. In addition, the bracket 20 has a connector member 28 located adjacent an inner part of the recess 18, and connecting the first and second flanges 22 and 24.

With reference to FIGS. 1–4, the cover mounting 10 has a blanket 30 having a generally rectangular shape. The blanket 30 has a pair of opposed side edges **32*a* and 32*b*, and a pair of opposed end edges 34*a* and 34*b* connecting the side edges 32*a* and b. In a preferred form, the blanket 30 has a brush 35 having a plurality of closely spaced fibers 36 defining an outer brush surface 38 for a purpose which will be described below. In one form, the blanket 30 and fibers 36** may be constructed from a suitable resilient material, such as nylon, a trademark of E.I. Dupont de Demours.

As best shown in FIGS. 1 and 2, the blanket 30 is placed over the roll 12, with opposed end margins 40 and 42 of the blanket 30 being received in the recess 16 of the roll 12. The blanket 30 has a pair of opposed resilient elongated clips 44 and 46, respectively, in the opposed end margins 40 and 42 of the blanket 30. Each of the clips 44 and 46 has a pair of spaced clipping members 48 and 50, and an elongated central member 52 connecting the clipping members 48 and 50 in a manner such that the clipping members 48 and 50 may flex relative to each other. The clipping members 48 and 50 define a pair of elongated grooves 54 and 56 in order to receive the first and second flanges 22 and 24 of the bracket 20, as will be discussed below.

In placing the blanket 30 on the roll 12, first one end margin 40 of the blanket 30 is placed in the recess 16 of the roll 12, and the associated clip 44 is placed on the first flange 22 of the bracket 20, such that the first flange 22 of the bracket 20 is received in the groove 54 of the clip 44, with the first and second flanges 22 and 24 of the bracket 20 flexing during placement of the end margin 40, such that the first flange 22 is received in the groove 54 of the clip 44 in order to releasably secure the end margin 40 of the blanket 30 in place in the recess 16.

Next, the blanket 30 is wrapped circumferentially around the roll 12, and the other end margin 42 of the blanket 30 is inserted into the recess 16 of the roll 12. At this time, the second flange 24 of the bracket 20 is placed in the groove 56 of the other clip 46 between the clipping members 48 and 50 in order to releasably secure the second end margin 42 of the blanket 30 in place in the recess 16. In this configuration, as best shown in FIG. 1, the outer portions of the end margins 40 and 42 of the blanket 30 are closely spaced relative to each other in order to close the recess 16 and minimize a possible gap between the end margins 40 and 42 over the recess 16 of the roll 12. In this manner, both end margins 40 and 42 of the blanket 30 are releasably secured to the bracket 20 in order to releasably retain the blanket 30 in an operative position on the roll 12.

In this configuration, in the event that the roll 12 comprises an ink roll, the roll 12 is rotated adjacent a source of ink in order to place the ink on the outer brush surface 38 of the blanket 30 in a uniform manner, such that it can be transferred from the ink roll to a pick up roll of the press 14. In this manner, the blanket 30 having a brush 35 defining the outer brush surface 38 may be positioned adjacent the pick up roll without the necessity of fixing a precise gap between the roll 12 and the pick up roll, since the ink is readily transferred in an improved manner from the roll 12 to the pick up roll due to the brush 35 of the blanket 30. In this manner, the blanket 30 may be placed on the roll 12 in a simplified manner in order to reduce down time of the press either before a press run or during a press run, for example, when it is desired to change colors in the press 14 by changing blankets 30.

Figure 3:
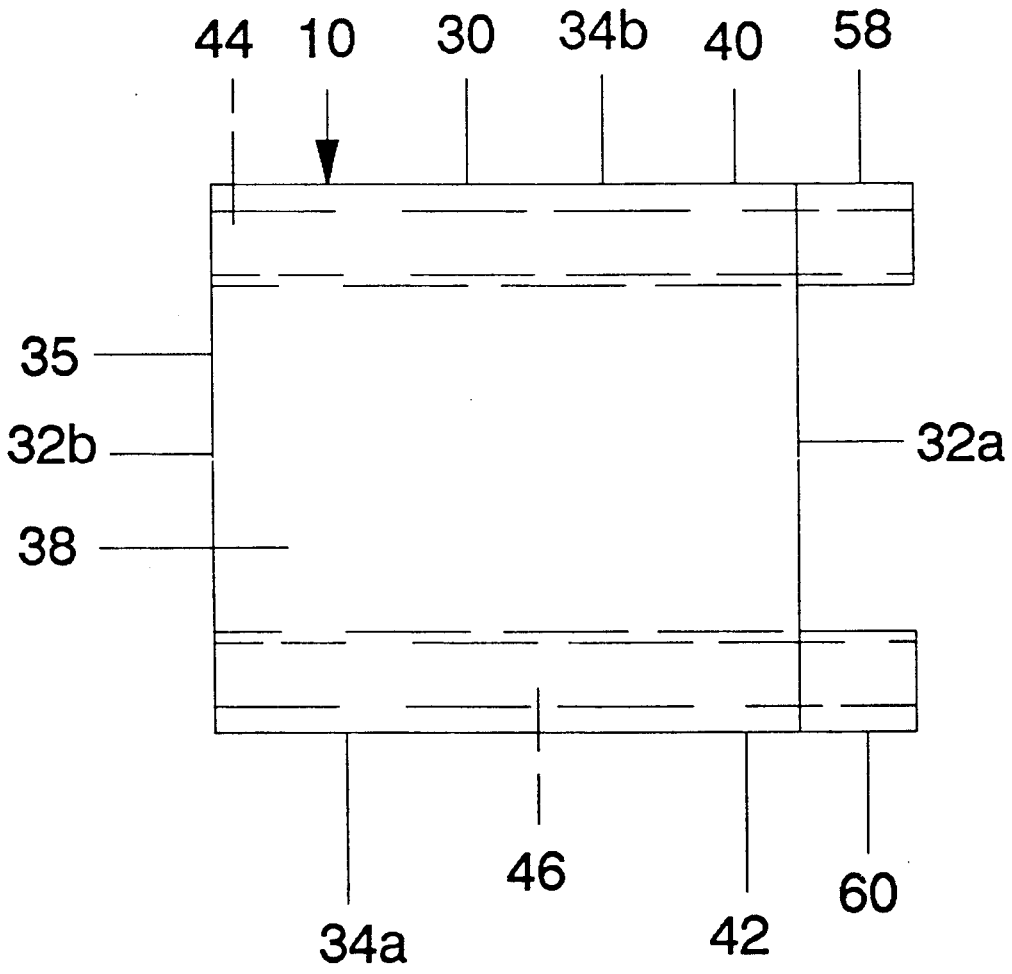
FIG. 3 is a plan view of the cover mounting for the roll of FIG. 1.
Figure 4:
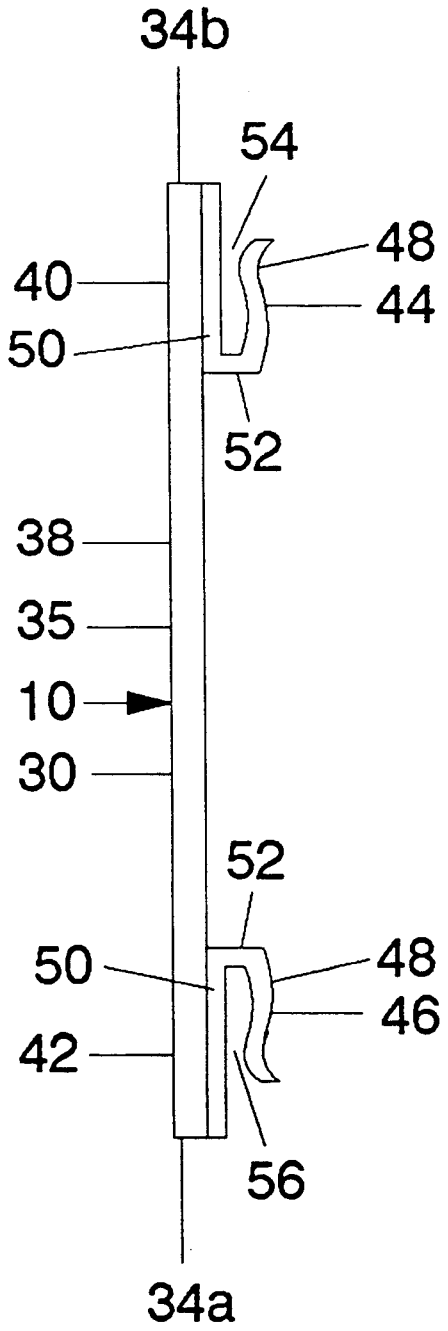
FIG. 4 is a sectional view taken substantially as indicated along the line 4—4 of FIG. 3.

As best shown in FIGS. 2 and 3, in a preferred form the blanket 30 has a pair of side tabs or handles 58 and 60 extending past the side edge 32*a* of the blanket 30. The tabs 58 and 60 may include a portion of the clips 44 and 46 being covered by fabric of the blanket 30, if desired. In this configuration, the tabs 58 and 60 extend past the side of the roll 12 during operation of the press 14.

When it is desired to remove the blanket 30 from the roll 12, one of the tabs 58 or 60 may be grasped in order to pull the respective end margin 40 or 42 off the bracket 20 in order to release the respective end margin 40 or 42 of the blanket 30. The blanket 30 is then unwrapped around the roll 12, and the tab or handle 58 or 60 adjacent the other end margin of the blanket 30 is then pulled through use of the tab 58 or 60 in order to completely remove the blanket 30 in a simplified manner from the roll 12.

Thus, in accordance with the present invention, the blanket 30 of the cover mounting 10 may be placed on the roll 12 in a simplified manner, and may be removed from the roll 12 in a simplified manner in order to decrease the down time of the press 14. In addition, the cover mounting 10 of the present invention eliminates the necessity of using tools which may otherwise be dropped into a lower part of the press during printing, and which could cause damage to the press.

Figure 5:
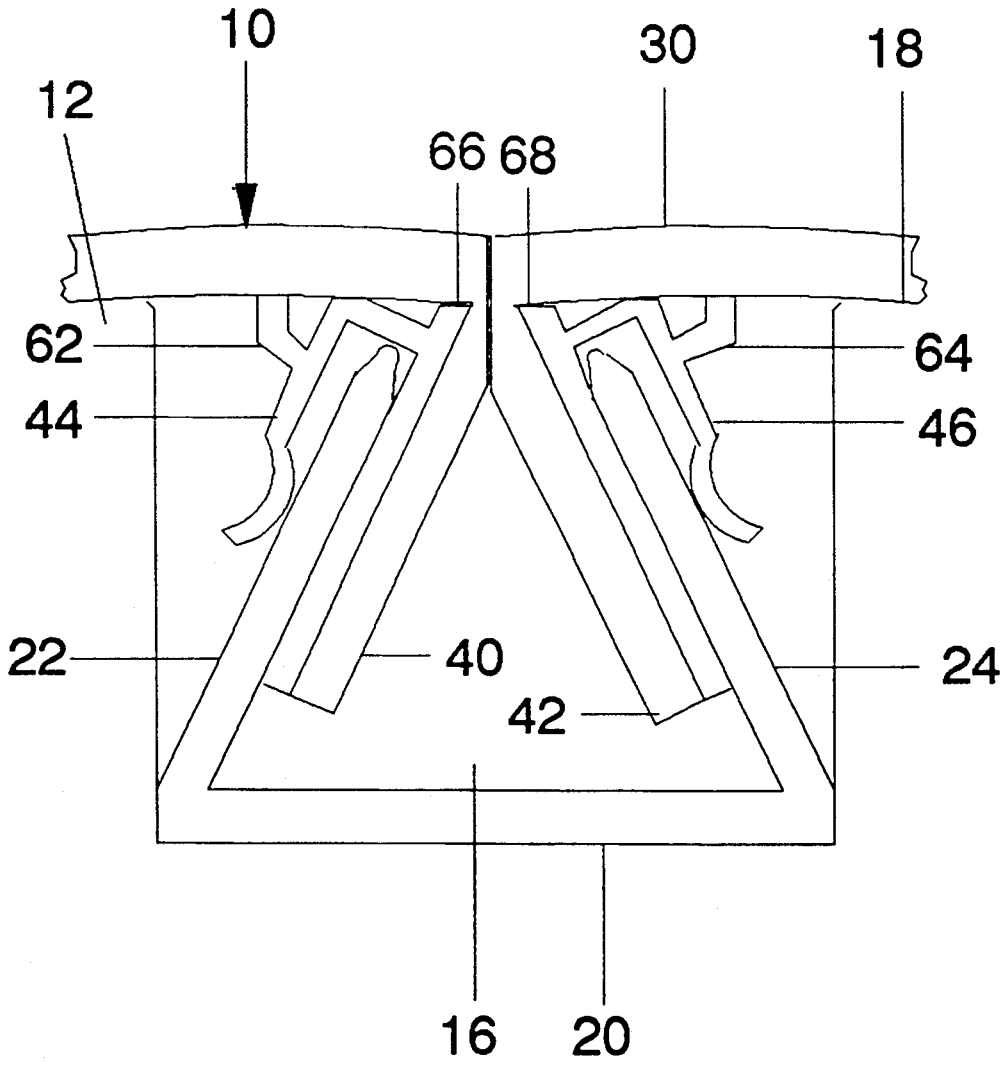
FIG. 5 is a sectional view of another embodiment of a securing bracket for a blanket of the present invention.

Another embodiment of the bracket 20 of the present invention is illustrated in FIG. 5, in which like reference numerals designate like parts. In this embodiment, the clips 44 and 46 have outwardly directed elongated support members 62 and 64 directed towards the outer surface 18 of the roll 12 and adjacent an upper end of the recess 16, such that the support members 62 and 64 of the clips 44 and 46, respectively, provide support for the blanket 30 at a location over the recess 16.

In addition, the first and second clips 44 and 46 of the blanket 30 have elongated closing members 66 and 68 extending outwardly and being generally aligned with the clipping members 50, such that the closing members 66 and 68 close the end margins 40 and 42 of the blanket 30 towards each other in order to reduce any gap which otherwise might exist between the end margins 40 and 42 of the blanket 30 adjacent the outer portion of the recess 16.

The foregoing detailed description has been given for clearness of understanding only, and no unnecessary limitations should be understood therefrom, as modifications will be obvious to those skilled in the art.

What is claimed is:

1. A cover mounting for a printing press, comprising:
   - a rotatably mounted roll having an elongated lateral recess extending from an outer surface of the roll;
   - a bracket having a pair of outwardly directed flanges in said recess; and
   - a blanket for covering said roll, said blanket having a pair of clips adjacent opposed ends of the blanket, with each of said clips having a pair of opposed spaced resilient clipping members for placement on each of the bracket flanges in said recess.

2. The mounting of claim 1 wherein said blanket includes a brush defining an outer brush surface.

3. The mounting of claim 1 wherein ends of the flanges of the bracket are directed towards each other in said recess.

4. The mounting of claim 3 wherein the flanges of the bracket define an elongated slot intermediate the flanges.

5. The mounting of claim 1 wherein said recess has a generally rectangular cross section.

6. The mounting of claim 1 wherein the clips extend in substantially the lateral length of the blanket.

7. The mounting of claim 1 wherein said blanket has a pair of outwardly directed tabs adjacent one side of the blanket.

8. The mounting of claim 1 including a pair of tabs which extend beyond sides of said blanket.

9. The mounting of claim 1 wherein the clipping members are spaced from each other a distance being the approximate thickness of the flanges.

10. The mounting of claim 1 wherein the clipping members are joined together by a connecting member adjacent one side of the clipping members.

11. The mounting of claim 1 wherein opposed end margins of said blanket extend into said recess and are closely spaced from each other.

12. The mounting of claim 1 wherein the clipping members have an outwardly directed support member directed towards the blanket from said recess.

13. The mounting of claim 1 wherein said roll comprises an ink roll adjacent a supply of ink.

14. The mounting of claim 1 wherein said roll comprises a plate cylinder.

15. A cover mounting for a printing press, comprising:

a rotatably mounted roll having an elongated lateral recess extending from an outer surface of the roll;

an elongated bracket having a pair of elongated first and second flanges directed towards an outer surface of the roll and towards each other, said bracket having a connecting member adjacent a lower part of the recess connecting the first and second flanges;

a blanket having a brush of closely spaced fibers defining an outer brush surface of the blanket, said blanket having a pair of resilient elongated clips adjacent opposed ends of the blanket, with each of the said clips having a pair of spaced clipping members and a central member connecting sides of the clipping members, and with the opposed clips being received on the first and second flanges in the recess.

* * * * *